US006996946B1

(12) United States Patent
Cazzolaro

(10) Patent No.: US 6,996,946 B1
(45) Date of Patent: Feb. 14, 2006

(54) STRUCTURES WHICH CAN BE DISMANTLED AND FOLDED, CONSISTING OF INTERCONNECTING TUBULAR ELEMENTS

(76) Inventor: Sergio Cazzolaro, Localita Villa Ivana I-26823, Castiglione d'Adda (IT)

( * ) Notice: Subject to any disclaimer, the term of this patent is extended or adjusted under 35 U.S.C. 154(b) by 0 days.

(21) Appl. No.: 09/913,995

(22) PCT Filed: Feb. 18, 2000

(86) PCT No.: PCT/IT00/00053

§ 371 (c)(1),
(2), (4) Date: Dec. 20, 2001

(87) PCT Pub. No.: WO00/50702

PCT Pub. Date: Aug. 31, 2000

(30) Foreign Application Priority Data

Feb. 26, 1999 (IL) ..... MI99A0393

(51) Int. Cl.
*E04C 3/02* (2006.01)
*E04C 3/28* (2006.01)

(52) U.S. Cl. ..... 52/645; 52/646; 52/655.1; 52/656.9; 24/546; 24/573.09; 403/286; 403/341; 403/397; 403/212; 403/292; 403/293

(58) Field of Classification Search ..... 403/286, 403/341, 331, 205, 213, 212, 292, 293, 297, 403/397; 135/143, 144, 131; 52/646, 645, 52/654.1, 655.1, 656.9, 687, 688, 287.1; 24/546, 573.09
See application file for complete search history.

(56) References Cited

U.S. PATENT DOCUMENTS 551,166 A * 12/1895 Kelsch ..... 403/286
1,368,642 A * 2/1921 Midgley ..... 24/573.09
1,697,699 A * 1/1929 Towill ..... 52/764
1,875,576 A * 9/1932 Een ..... 52/656.9
2,803,317 A * 8/1957 Henderson ..... 52/656.9
2,882,564 A * 4/1959 Couse et al. ..... 52/655.1
3,313,082 A * 4/1967 Dodds et al. ..... 52/646
3,572,223 A * 3/1971 Vierregger ..... 52/296
3,783,573 A * 1/1974 Vaughan ..... 52/646
4,114,330 A * 9/1978 Sukolics ..... 52/200
4,420,087 A * 12/1983 Johns ..... 211/189
4,440,363 A * 4/1984 Brand ..... 244/114 R
4,584,806 A * 4/1986 Graham, Jr. ..... 52/285.3
4,684,156 A * 8/1987 Rhodes ..... 285/27
4,831,803 A * 5/1989 Leonardis ..... 52/323
4,838,003 A * 6/1989 Zeigler ..... 52/646
4,982,546 A * 1/1991 Lange ..... 52/648
4,995,212 A * 2/1991 Morgan et al. ..... 52/646

(Continued)

FOREIGN PATENT DOCUMENTS

EP 0 419 006 1/1995

(Continued)

*Primary Examiner*—Phi Dieu Tran A
(74) *Attorney, Agent, or Firm*—Pauley Petersen & Erickson

(57) ABSTRACT

Composite structures obtained by joining two or more structures of the type which presents pairs of joined tubular elements, whose extremity is hinged in universal joints and in which the universal joints are substantially parallelepiped in form and present four seats of hinging corresponding to the sides faces, in which the universal joints present grooves along the sides of the face, in which are scheduled the seats to hinge the extended elements, in proximity of the edges and parallel to the same edges, that cooperate with C-sectioned fixing elements to hold united two matched universal joints belonging to two structures from join.

7 Claims, 3 Drawing Sheets

U.S. PATENT DOCUMENTS

| | | | | | |
|---|---|---|---|---|---|
| 5,078,530 | A | * | 1/1992 | Kim | 403/24 |
| 5,499,886 | A | * | 3/1996 | Short et al. | 403/219 |
| 5,577,857 | A | * | 11/1996 | Miyasaka et al. | 403/316 |
| 5,794,640 | A | * | 8/1998 | Jang | 135/131 |
| 6,253,507 | B1 | * | 7/2001 | Martino | 52/211 |
| 6,282,860 | B1 | * | 9/2001 | Ramirez | 52/677 |

FOREIGN PATENT DOCUMENTS

| | | | | |
|---|---|---|---|---|
| EP | 0 884 425 | | 12/1998 | |
| FR | 2585417 | * | 7/1985 | 52/688 |
| GB | 2072297 | * | 9/1981 | 52/656.9 |
| GB | 2146367 | * | 4/1985 | 52/656.9 |

* cited by examiner

STRUCTURES WHICH CAN BE DISMANTLED AND FOLDED, CONSISTING OF INTERCONNECTING TUBULAR ELEMENTS

BACKGROUND OF THE INVENTION

This invention relates to folding structures consisting of interconnected extended tubular elements. More particularly, this invention relates to portable folding structures which can be extended horizontally or vertically, that can be used for product display or as supports for raised loads, such as for instance platforms, walkway bases, technical pavements, rostrums, stands, boxes. These structures comprise a plurality of interconnected parallelepiped cells in which the sides faces of the parallelepiped are defined by a pair of tubular elements interconnected by a scissors-connector. In these structures, each extremity of the extended tubular elements which constitute the pair of scissors-connected elements, is inserted by rotation into a seat in an articulated universal joint, also parallelepiped in form. The universal joint presents, on one of the larger faces, a hinging seat corresponding to each side face, and can therefore accept up to four extremities of tubular elements. In the case of structures that must bear heavy loads, a variation to the embodiment described above has been used for some time in which the universal joints provide for a fifth seat on the surface of said face into which is fixed a tubular element, within which another tubular element of smaller diameter is inserted as a sliding fit and whose extremity is inserted into the face of a similar universal joint. The tubular element inserted into the face of the universal joint is fixed and is stopped against the opposed joint into which is inserted the extremity of the element that slides inside.

It is often necessary to arrange for exhibition structures or raised support higher than is attainable with the single structure. In this case, more identical (or similar) structures are superimposed such that, in the overlap, the upper faces of the universal joints of the underlying structure are matched to the corresponding lower faces of the upper structure.

Devices are known to increase the height of the exhibition or support systems mentioned above. For instance, an exhibition system that could give rise to structures of different height is described in European Patent EP-A-0 419 006.

The structure described in this patent is complex, provides for a plurality of articulated elements and therefore requires long assembly and dismantling times.

The system proposed in European Patent EP-A-0 884 425 provides for uniting the joints of two structures by connecting the extremities of the two telescopic elements, for instance by means of screw or pin systems.

This system also presupposes complex and onerous setting-up operations, as well as relatively long dismantling and assembly times.

SUMMARY OF THE INVENTION

It is one object of this invention to provide a simple and rapid method of joining two or more structures of the type comprising pairs of extended tubular shear-connected elements, whose extremity is hinged in universal joints and in which the universal joints are defined integral with equal and parallel larger faces and are preferably substantially parallelepiped in form and present four hinging seats set in one of the larger faces near a side face.

It is another object of this invention to provide a means for coupling two or more superimposed structures of the type described above that furthermore present in the inside surface of the face of the universal joint, in which are seats for the hinging of the extended elements, a fifth seat into which is fixed the extremity of an extendible telescopic tubular element whose other extremity is fixed to the opposite underlying universal joint.

It is yet another object of this invention to provide a device that allows the coupling of the aforesaid structures.

These and other objects are addressed using the universal joints described above that form grooves along the sides of the face, in which are scheduled seats for lodging the extended elements in proximity to the edges of the type and parallel to the same edges, that cooperate with C-sectioned fixing elements to hold two matching universal joints belonging to two superimposed structures together.

According to a preferred embodiment of this invention, the C-shaped fixing elements are substantially rectangular sheets of flexible material with two opposite edges folded and inverted, also referred to herein as the C-shaped spring or C-spring. The folded and inverted edges of the C-shaped spring present dimensions and forms corresponding to those of the grooves cut into the faces of the universal joints.

The C-shaped springs with inverted edges cover a substantial portion of the corresponding side faces of the superimposed universal joints and they could provide for, in some cases, cut-outs in correspondence with seats of lodgement of the extended elements and they could take different configurations depending on their use.

The C-shaped springs can be applied to all the side faces of all the joints that are matched in the overlap or in coupling of multiple structures.

It has been found, however, that to get sufficient stability, in most cases it is sufficient to apply the C-springs only on the external faces of the universal joints that are on the external surface of the structure. The application of the C-springs to only the external faces of the joints enormously simplifies the operation of assembly and dismantling of the coupled structures.

To further guarantee the stability of the joined structure, the faces of the matching joints can form one or more suitable perforations for the housing pivots that prevent any movement of the joints on the contact pivot.

BRIEF DESCRIPTION OF THE DRAWINGS

These and other objects and features of this invention will be better understood from the following detailed description taken in conjunction with the drawings, which are by way of example only and should not be interpreted as limiting the invention, wherein.

DETAILED DESCRIPTION OF THE PRESENTLY PREFERRED EMBODIMENTS

Figure 4:
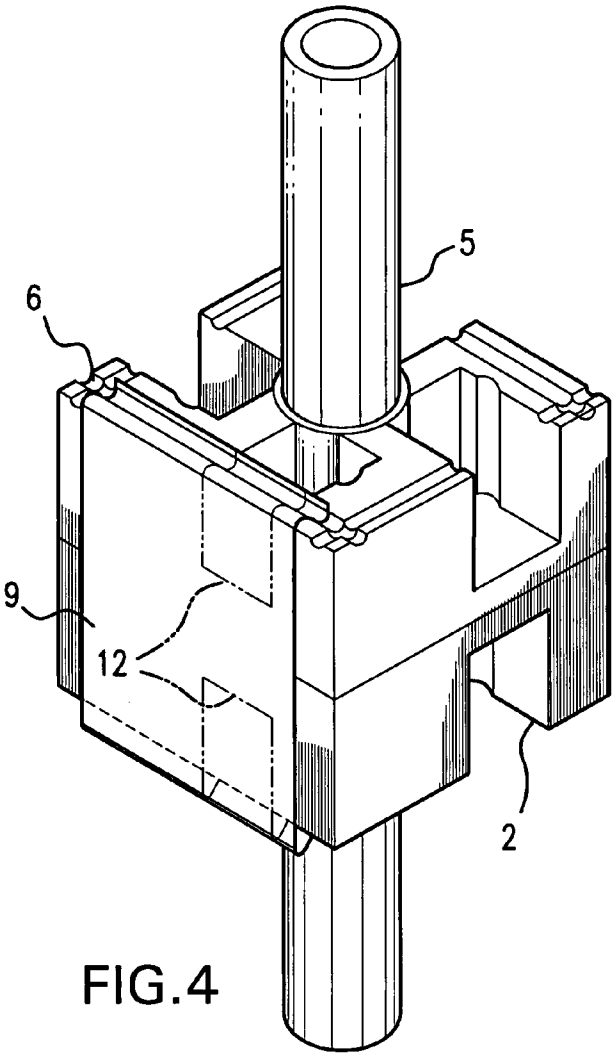
FIG. 4 shows a side view of two joints belonging to two superimposed structures fixed together by means of the springs of FIGS. 2 and 3.

With reference to FIGS. 1 to 4, the universal joint 1 forms four seats 2, 2', 2" and 2'" on one of its larger faces in correspondence with each side face, that can accept hinged extended tubular elements, not shown in the figure. On larger face 3 of the universal joint that forms the four seats (2, 2', 2" and 2'") there is an opening 4 to fix the extremity of a tubular extended element 5 (shown in FIG. 4), within which another tubular element slides, not shown in the figure, and connected with a corresponding universal joint. The edges of the face of the universal joint form grooves 6 which constitute seats to accept one of the extremities 8 (shown in FIGS. 2 and 3) of a spring 9 as shown in FIG. 4. In one embodiment of the invention, as shown in FIG. 4, the spring 9 can include two cut-outs 12 (shown in phantom) that correspond to the seats (2, 2', 2" and/or 2'").

The insertion of the two extremities 8 of the spring 9 into the grooves on the nonmatching faces of two joints belonging to two superimposed structures allows the coupling of the structures to be maintained fixed. The insertion of the springs is easily achieved after the structures have been superimposed by snapping the inverted extremities 8 of the springs 9 into the grooves 6, where they remain locked. The operation of dismantling is performed quickly, for instance, by removing one of the two inverted extremities 8 of the C-springs 9 from the groove 6.

Figure 3:
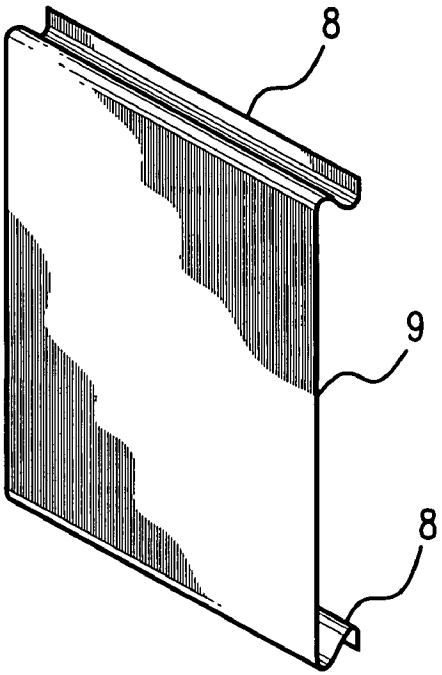
FIG. 3 is a view in perspective of the spring of FIG. 2.
Figure 2:
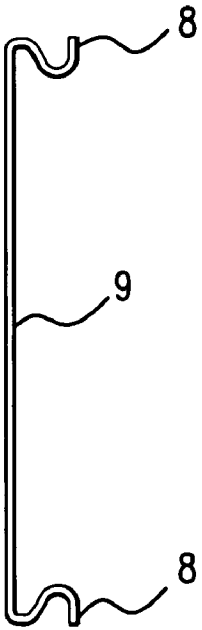
FIG. 2 shows a side view of a C-sectioned spring suitable for use with the joint of FIG. 1.
Figure 1:
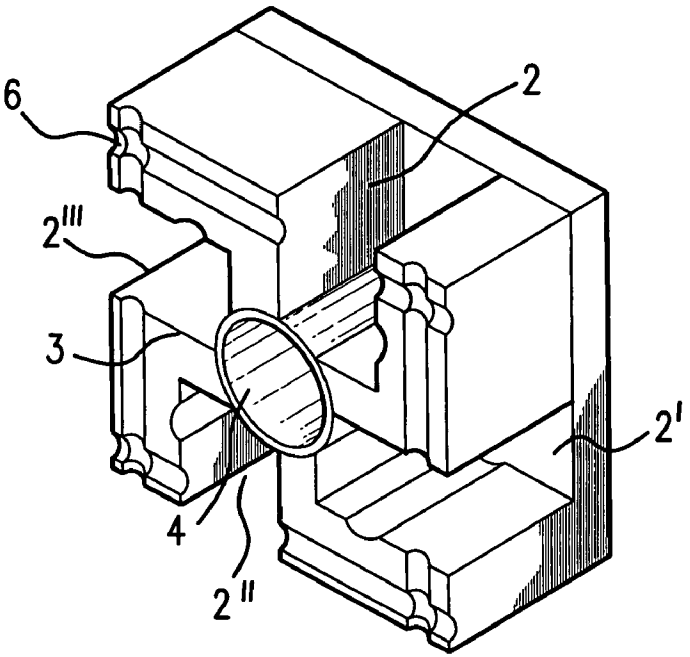
FIG. 1 shows a view in perspective of a universal joint in accordance with one embodiment of this invention.
Figure 5:
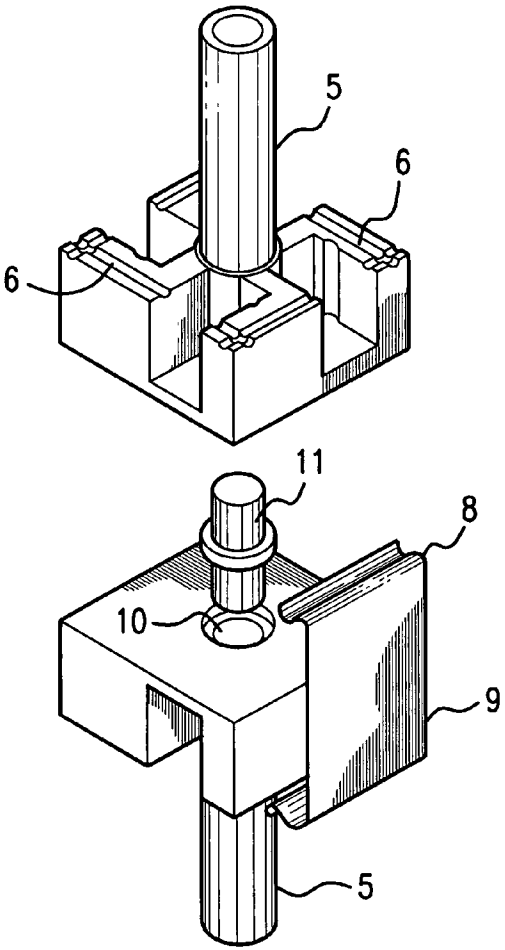
FIG. 5 is an exploded view of a preferred system of connection of structures in accordance with one embodiment of this invention.

FIG. 5 shows a preferred embodiment of this invention, which provides for the use of universal joints whose face opposite to that in which the grooves have been made contains the opening 10 that can accept pivots 11 that prevent any relative movement of the joints in the horizontal plane.

Figure 6:
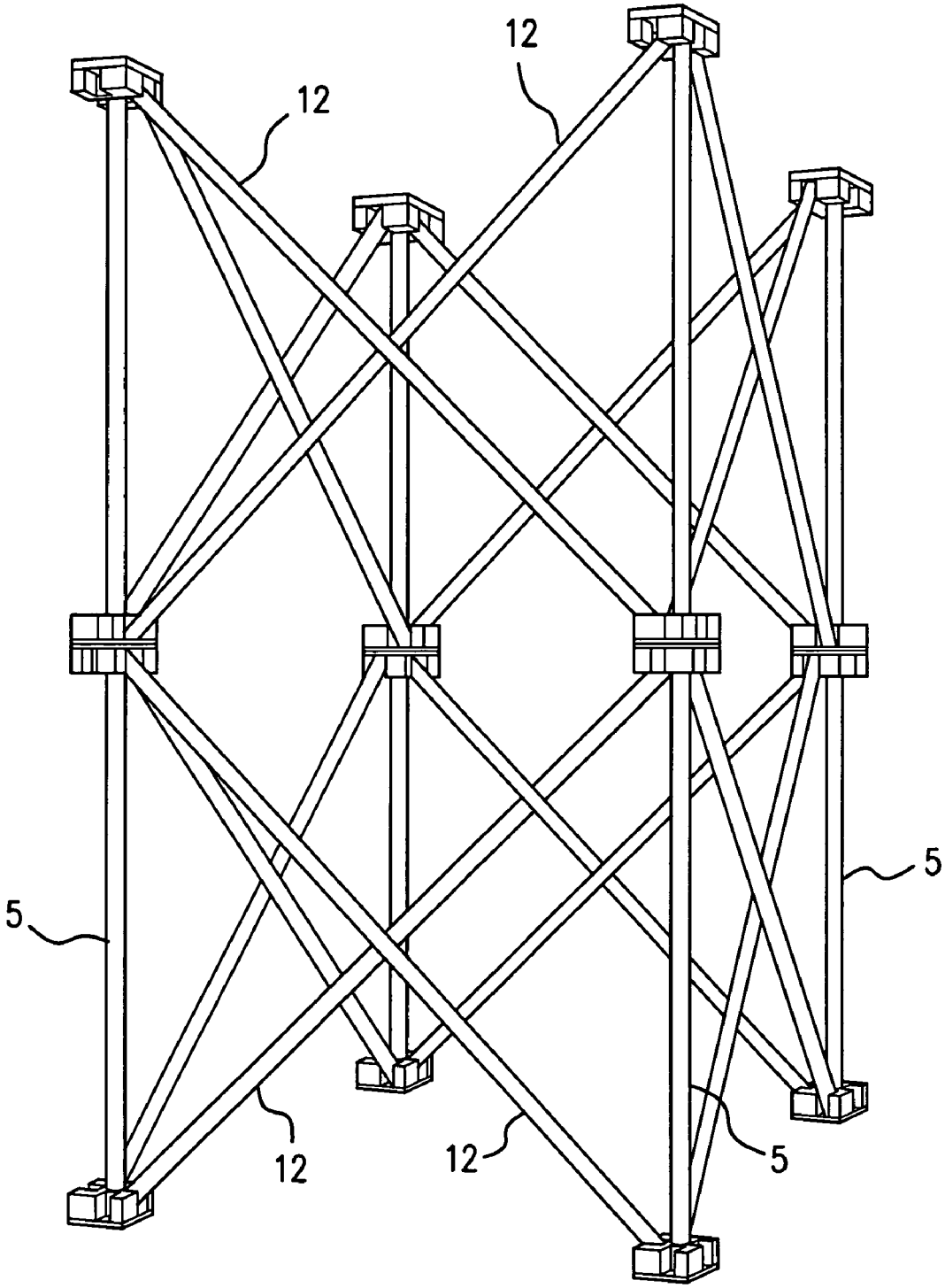
FIG. 6 is a simplified scheme of two superimposed structures coupled according to one embodiment of this invention.

FIG. 6 shows a side view of a support system for elevated loads according to one embodiment of this invention, obtained by joining two structures.

The said figure shows the extended elements 12 joined with scissors-connection and hinged in seats 2 of the universal joint, as well as the telescopic extension elements 5, that assure resistance to loading of the structure.

I claim:

1. In a composite structure comprising at least two coupled structures, wherein each of the at least two coupled structures comprises a plurality of pairs of scissors-connected tubular elements having extremities hinged in universal joints, said universal joints being integral delimited by substantially equal and parallel faces and forming four seats, each of the four seats in correspondence with a side face to accept hinged elements, the improvement comprising:

each of said universal joints including a groove along each side of a larger face forming the four seats, said groove proximate to and parallel to a corresponding edge of each said side face; and a C-sectioned fixing element including two folded and inverted edges;

the C-sectioned fixing element holding united two matching said universal joints such that the larger face of one of the two matching said universal joints is disposed in a direction opposite the larger face of the other of the two matching said universal joints, wherein one of the folded and inverted edges is inserted into one groove of one of the two matching said universal joints and the other of the folded and inverted edges is inserted into one groove of the other of the two matching said universal joints to snap the C-sectioned fixing element to the two matching said universal joints wherein the C-sectioned fixing element covers a substantial portion of a corresponding side face of superimposed universal joints and includes cut-outs corresponding to the seats for the hinged extended elements.

2. A composite structure according to claim 1, wherein the at least two coupled structures are superimposed and each includes, in an inside surface of the larger face of the universal joint having said four seats, a fifth seat in which is fixed an extremity of an extendible telescopic tubular element whose other extremity is fixed to an opposed universal joint.

3. A composite structure according to claim 1, wherein the C-sectioned fixing element includes a substantially rectangular sheet of flexible material.

4. A composite structure according to claim 1, wherein matching faces of the universal joints of the coupled structures include at least one suitable perforation for housing a pivot that prevents any horizontal movement of the universal joints.

5. A composite structure according to claim 2, wherein the C-sectioned fixing element includes a substantially rectangular sheet of flexible material.

6. A composite structure according to claim 5, wherein matching faces of the universal joints of the coupled structures include at least one suitable perforation for housing a pivot that prevents any horizontal movement of the universal joints.

7. A composite structure according to claim 2, wherein matching faces of the universal joints of the coupled structures include at least one suitable perforation for housing a pivot that prevents any horizontal movement of the universal joints.

* * * * *